US005332878A

United States Patent [19]

Borst et al.

[11] Patent Number: 5,332,878

[45] Date of Patent: Jul. 26, 1994

[54] SWITCH AND ACTUATOR ASSEMBLY

[75] Inventors: James A. Borst, Sandy Hook; Donald G. Williams, Sherman; Mark A. Chantry, Cheshire; James S. Laflam, Bethel, all of Conn.

[73] Assignee: Eaton Corporation, Cleveland, Ohio

[21] Appl. No.: 72,884

[22] Filed: Jun. 7, 1993

[51] Int. Cl.[5] ..... H01H 3/00

[52] U.S. Cl. ..... 200/329; 200/330; 200/332; 200/335

[58] Field of Search ..... 200/329, 330, 331, 332, 200/335, 336, 337, 338, 342, 562, 47, 400, 564, 573, 7; 74/504, 557

[56] References Cited

U.S. PATENT DOCUMENTS

| | | | |
|---|---|---|---|
| 1,480,276 | 1/1924 | Leake | 335/75 |
| 1,894,098 | 1/1933 | Janisch | 200/17 R |
| 2,125,095 | 7/1938 | Zurcher | 200/81.5 |
| 2,454,341 | 11/1948 | Repka | 200/332 |
| 2,511,271 | 6/1950 | Kominky et al. | 200/332 |
| 3,207,860 | 9/1965 | Korsgren, Jr. et al. | 200/7 |
| 3,247,349 | 4/1966 | Duncan | 200/336 |
| 4,362,916 | 12/1982 | Anderson | 200/332 |

*Primary Examiner*—Ernest G. Cusick
*Assistant Examiner*—David J. Walczak
*Attorney, Agent, or Firm*—Tarolli, Sundheim & Covell

[57] ABSTRACT

A known switch is mounted on a base of a switch actuator assembly. When the switch is to be actuated, an input shaft and switch actuator member are rotated together relative to the base. A helical return spring urges the input shaft back toward the initial position. When the input shaft and switch actuator member have been rotated together to an actuated position, the switch is actuated and the switch actuator member engages a stop surface. During continued rotation of the input shaft from the actuated position to an overtravel position, a pin connected with the input shaft moves away from one end of a slot in the switch actuator member. A helical overtravel spring is deflected along with the return spring. Deflection of the overtravel spring urges the switch actuator member and input shaft back toward their initial position relative to each other.

8 Claims, 2 Drawing Sheets

SWITCH AND ACTUATOR ASSEMBLY

BACKGROUND OF THE INVENTION

The present invention relates to an improved switch actuator assembly for actuating a switch and more specifically to a switch actuator assembly which accommodates overtravel of an input shaft relative to a switch actuator member.

When a switch is to be actuated by a linkage, such as a thrust reverser door linkage on an aircraft, the switch must be accurately positioned relative to the linkage. Accurate positioning of the switch relative to the linkage requires substantial time due to tolerances in components of the linkage. After the linkage has been used for a relatively long time, wear and/or slight loosening of the linkage may require repositioning of the switch.

SUMMARY OF THE INVENTION

The present invention relates to a new and improved switch and switch actuator assembly. The switch actuator assembly includes a switch actuator member which is mounted on a rotatable input shaft. A return spring is connected with the input shaft and a base of the switch actuator assembly. An overtravel spring is connected with the input shaft and the switch actuator member.

Upon rotation of the input shaft from an initial position to an actuated position, the switch actuator member is rotated with the input shaft to actuate the switch. The return spring biases the input shaft and switch actuator member back toward the initial position. Continued rotation of the input shaft from the actuated position, rotates the input shaft relative to the switch actuator member. During this rotation, a pin moves away from one end of a slot in the switch actuator member and the overtravel spring is deflected along with the return spring.

When the direction of rotation of the input shaft is reversed, the input shaft rotates relative to the switch actuator member while the overtravel spring urges the pin toward the end of the slot in the switch actuator member. After the pin engages the end of the slot in the switch actuator member, continued rotation of the input shaft results in the switch actuator member and overtravel spring moving with the input shaft. During continued rotation of the input shaft, the switch actuator member and input shaft are both urged back toward the initial position under the influence of the return spring.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
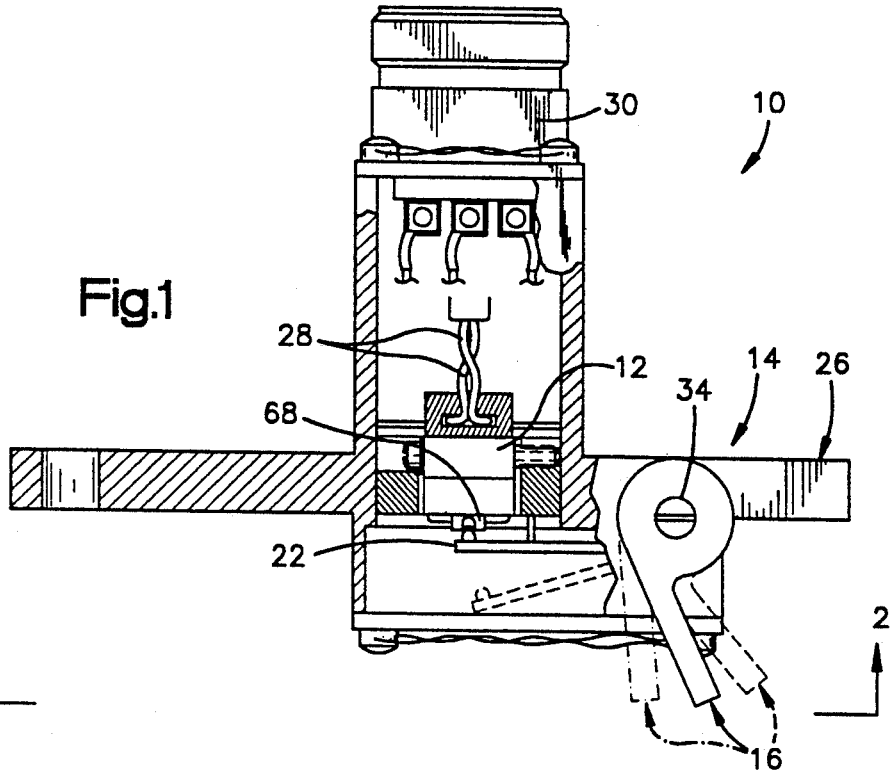
FIG. 1 is a partially broken away side elevational view of a switch and actuator assembly.
Figure 2:
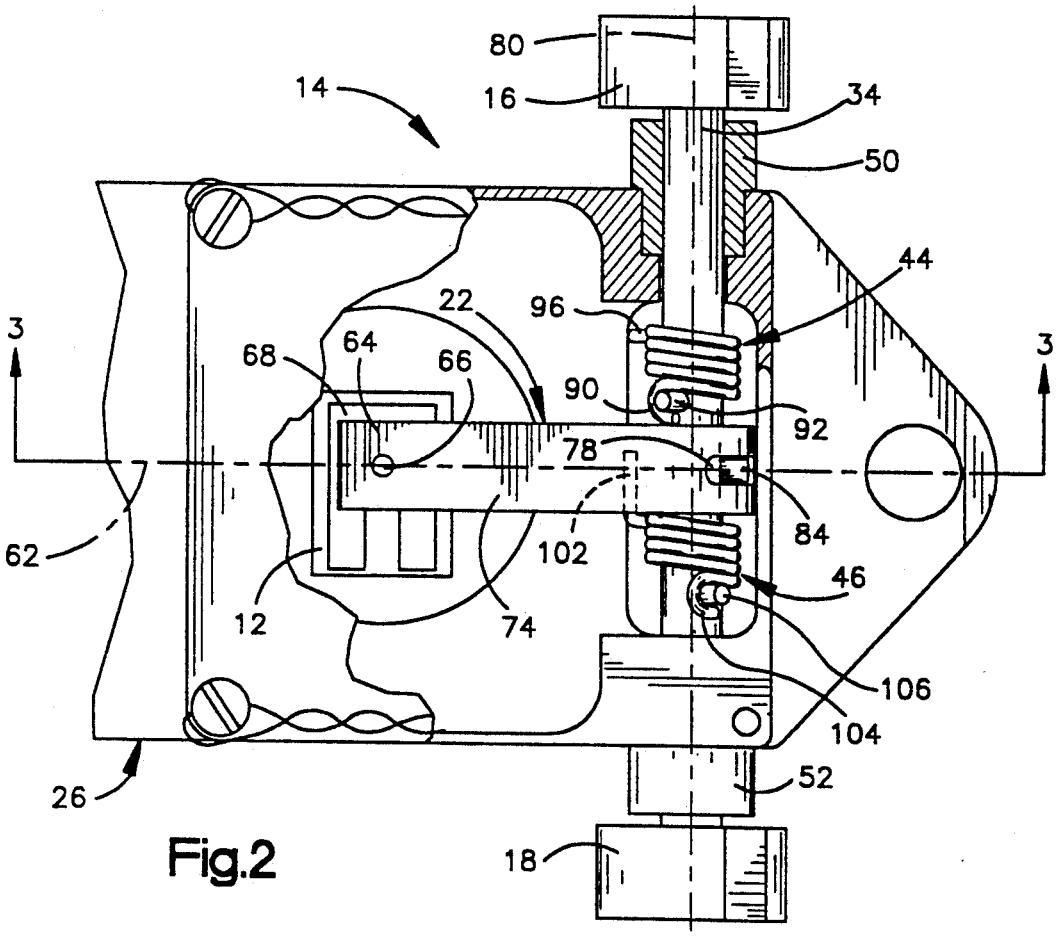
FIG. 2 is an enlarged fragmentary plan view, taken generally along the line 2—2 of FIG. 1, illustrating the construction of a switch actuator assembly constructed in accordance with the present invention.

A switch and actuator assembly 10 constructed in accordance with the present invention is illustrated in FIG. 1. The switch and actuator assembly 10 includes a known switch 12 which is actuated by an improved switch actuator assembly 14. The switch and actuator assembly 10 is operated by a pair of input levers 16 and 18 (FIG. 2).

The input levers 16 and 18 are rotatable together from an initial position, indicated in dashed lines in FIG. 1 for the input lever 16. The input lever 16 is rotatable in a clockwise direction (as viewed in FIG. 1) from the initial position to an actuated or second position shown in solid lines in FIG. 1. When the input lever 16 is in the actuated position shown in solid lines in FIG. 1, a switch actuator member 22 is effective to actuate the switch 12. The input lever 16 is rotatable in a clockwise direction to an overtravel position shown in dash-dot lines in FIG. 1 while the switch actuator member 22 remains stationary in the actuated position.

The switch 12 (FIG. 1) is mounted on a base 26 of the switch actuator assembly 14. Suitable leads or wires 28 connect the switch 12 with a connector assembly 30. The connector assembly 30 is used to interconnect the switch 12 with electrical circuitry.

The switch and actuator assembly 10 may be used in many different environments for many different purposes. However, the switch and actuator assembly 10 is advantageously used on an aircraft in association with thrust reverser stow and deploy circuitry. For this specific use, the switch 12 is a double pole snap action electrical switch. However, it is contemplated that the switch 12 could have many different constructions and that the switch could be used in association with many different types of electrical circuits. Thus, the invention is not be considered as being limited to any particular construction of the switch 12 or to use of the switch and actuator assembly 10 in association with any particular type of circuitry.

Switch Actuator Assembly—General Description

The improved switch actuator assembly 14 (FIG. 2) includes an input shaft 34 which is rotatable relative to the base 26 by the input levers 16 and 18. The switch actuator member 22 is rotatably mounted on the input shaft 34. The switch actuator member 22 rotates with the input shaft 34 from the initial position (FIG. 3) to an actuated position (FIG. 4) to actuate the switch 12.

Figure 3:
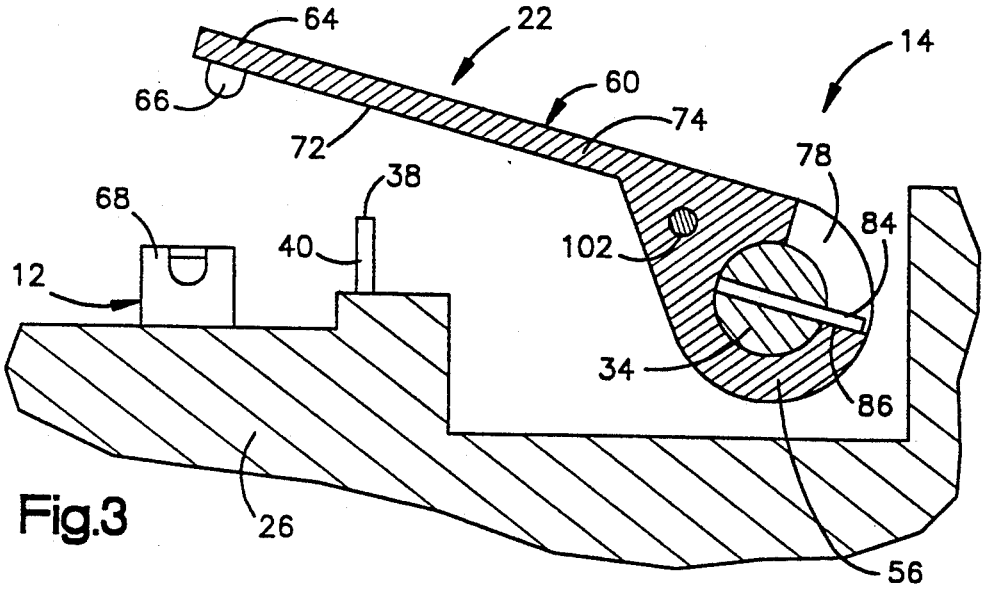
FIG. 3 is an enlarged fragmentary sectional view, taken generally along the line 3—3 of FIG. 2, illustrating the relationship of a switch actuator member to the switch when the switch actuator member and an input shaft are in an initial position.
Figure 4:
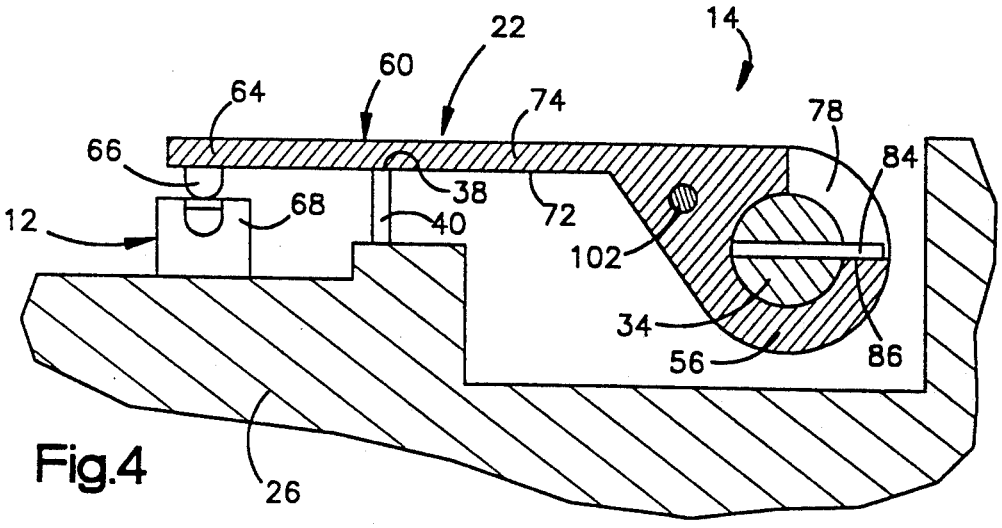
FIG. 4 is a fragmentary sectional view, generally similar to FIG. 3, illustrating the switch actuator member and input shaft in an actuated position.

When the switch actuator member 22 is in the actuated position of FIG. 4, the switch actuator member engages a flat circular stop surface 38 on the upper (as viewed in FIGS. 3 and 4) end of a cylindrical stop pin 40. Engagement of the switch actuator member 22 with the stop surface 38 blocks further rotation of the switch actuator member with the input shaft 34. However, the input shaft 34 is rotatable relative to the switch actuator member 22, from the actuated position of FIG. 4 to an overtravel position (FIG. 5) in a range of overtravel positions.

As the switch actuator member 22 is moved to the actuated position of FIG. 4, the switch 12 is actuated. However, the input shaft 34 can continue to rotate relative to the stationary switch actuator member 22 without increasing the force applied by the switch actuator member against the switch 12. Thus, abutting engagement of the switch actuator member with the stop pin 40 blocks the switch actuator member 22 against movement from the actuated position of FIG. 4.

Since the input shaft 34 can continue to rotate relative to the switch actuator member 22 while the switch actuator member remains stationary in the actuated position, the switch actuator assembly 14 can accommodate overtravel of the input shaft 34. This eliminates the necessity of accurately positioning the switch and actuator assembly 10 (FIG. 1) relative to an associated mechanism.

For example, if the switch and actuator assembly 10 is used in association with a thrust reverser door linkage, the ability of the switch actuator assembly 14 to accommodate overtravel of the input levers 16 and 18 and input shaft 34 eliminates the necessity of precisely positioning the switch and actuator assembly 10 relative to the thrust reverser door linkage. Any wear and/or minor misalignment of components of the thrust reverser door linkage during use is accommodated by the switch assembly. This is because the wear and/or minor misalignments merely effect the extent of overtravel of the input shaft 34 relative to the switch actuator member 22 after the switch actuator member has been moved to the actuated position of FIG. 4.

A return spring 44 is connected with the input shaft and the base 26. The return spring 44 biases the input shaft 34 and switch actuator member 22 toward the initial position shown in FIG. 3. When the input shaft 34 and switch actuator member 22 are moved from the initial position of FIG. 3 to the actuated position of FIG. 4, the return spring 44 is resiliently deflected to bias the switch actuator member 22 and input shaft 34 back toward the initial position of FIG. 3.

An overtravel spring 46 is connected with the input shaft 34 and the switch actuator member 22. The overtravel spring 46 is deflectable to accommodate overtravel of the input shaft 34 relative to the switch actuator member 22. The overtravel spring 46 biases the input shaft 34 and switch actuator member 22 toward their initial spatial relationship illustrated in FIG. 3. The overtravel spring 46 maintains the input shaft 34 and switch actuator member 22 in this initial spatial relationship during rotation of the input shaft 34 and switch actuator member together from the initial position of FIG. 3 to the actuated position of FIG. 4.

Figure 5:
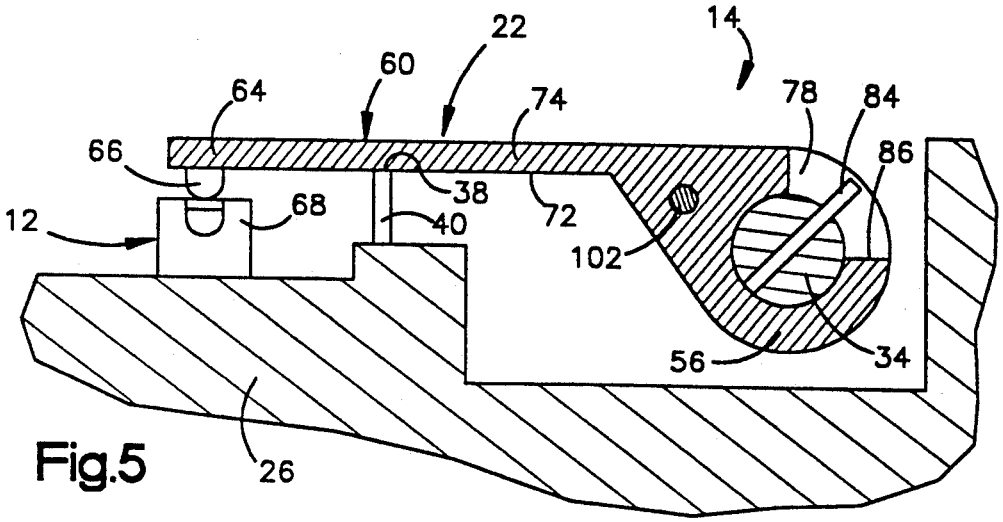
FIG. 5 is a fragmentary sectional view, generally similar to FIG. 4, illustrating the switch actuator member and input shaft when the input shaft is in an overtravel position and the switch actuator member is in the actuated position.

During rotation of the input shaft 34 from the actuated position shown in FIG. 4 to the overtravel position shown in FIG. 5, the overtravel spring 46 and return spring 44 are both resiliently deflected. The overtravel spring 46 is resiliently deflected by rotation of the input shaft 34 relative to the switch actuator member 22. The return spring 44 is resiliently deflected by rotation of the input shaft 34 relative to the base 26. When the switch actuator member 22 is in the actuated position of FIG. 5 and the input shaft 34 has been moved to an overtravel position in a range of overtravel positions, the overtravel spring 46 urges the switch actuator member back toward the initial spatial relationship relative to the input shaft. The return spring 44 urges the input shaft 34 back toward the initial position of FIG. 3.

Input

The input shaft 34 has a cylindrical configuration and is rotatably supported on the base 26 by a pair of generally cylindrical oil impregnated, sintered bronze bushings 50 and 52 (FIG. 2). The input levers 16 and 18 are formed of heat treated steel and are fixedly connected to opposite ends of the input shaft 34 by suitable pins (not shown). The input levers 16 and 18 are engaged by pins on thrust reverser door linkages or other members, to rotate the input levers 16 and 18 and the input shaft 34 relative to the base 26 and switch 12.

The input levers 16 and 18 rotate the input shaft 34 through approximately 15° from the initial or first position shown in dashed lines in FIG. 1 and illustrated in FIG. 3 to an actuated or second position, shown in solid lines in FIGS. 1 and 4. The input levers 16 and 18 (FIG. 2) rotate the input shaft 34 relative to the base 26 and stationary switch actuator member 22 from the actuated or second position indicated in solid lines in FIGS. 1 and 4 to an overtravel or third position indicated in dash-dot lines in FIG. 1 and solid lines in FIG. 5.

The extent of movement of the input levers 16 and 18 (FIGS. 1 and 2) from the actuated position, shown in solid lines in FIG. 1, to the overtravel position may vary within a range of approximately 55°. The extent of overtravel of the input shaft 34 relative to the switch actuator member 22 will usually be approximately 30° from the actuated position of FIG. 4 to the overtravel position of FIG. 5. The extent of overtravel rotation of the input shaft 34 relative to the switch actuator member 22 will vary depending upon the precise position of the switch and actuator assembly 10 (FIG. 1) relative to an actuating linkage and the tolerances and wear of components of the actuating linkage.

It is contemplated that the amount of overtravel rotation of the input shaft 34 relative to the switch actuator member 22 after the switch actuator member has been moved to the actuated position of FIG. 4 will vary during extended use of the linkage or other mechanism with which the switch and actuator assembly 10 is associated. It should be understood that the foregoing specific amounts of overtravel have been set forth herein for purposes of clarity of description. The invention is not to be limited to any specific amount of overtravel of the input shaft 34 relative to the switch actuator member 22.

Switch Actuator Member

The switch actuator member 22 has a body section 56 which extends around the input shaft 34 (FIG. 3). A cylindrical central opening through the body section 56 has an inside diameter which is slightly greater than the outside diameter of the input shaft 34. This allows the switch actuator member 22 to rotate relative to the input shaft 34.

An elongated and generally rectangular arm section 60 extends outwardly from the body section 56 of the switch actuator member 22. The arm section 60 is formed as one piece with the body section 56. The arm section 60 has a longitudinal central axis 62 (FIG. 2). The arm section 60 has an outer end portion 64 having a central opening in which a screw 66 is threaded.

The screw 66 is adjustable relative to the arm section to accommodate variations in the position of a switch actuator element 68 relative to the base 26. Thus, the position of the screw 66 relative to the outer end portion 64 of the arm section 60 can be adjusted to enable the switch actuator member 22 to depress the switch actuator element 68 by the precise amount necessary to actuate the switch 12 when the switch actuator member is in the actuated position of FIG. 4.

The elongated arm section 60 of the switch actuator member 22 has a rectangular lower (as viewed in FIG. 3) side surface 72 on an intermediate section 74. The lower side surface 72 abuttingly engages the stop surface 38 to limit downward (as viewed in FIGS. 3 and 4) movement of the switch actuator member 22 from the actuated position of FIG. 4.

An arcuate slot 78 is formed in the body section 56 of the switch actuator member 22 (FIG. 3). The arcuate slot has a center which is coincident with a central axis 80 (FIG. 2) of the input shaft 34. A pin 84 (FIGS. 2 and 3) extends radially outwardly from the input shaft 34 into the slot 78. The arcuate slot 78 has an arcuate central axis which is disposed in the same plane as the central axis 62 of the arm section 60. The plane containing the central axes of the arm section 60 and slot 78 extends perpendicular to the central axis 80 of the input shaft 34.

During movement of the input shaft 34 from the initial or first position of FIG. 3 to the actuated or second position of FIG. 4, the pin 84 remains in abutting engagement with one end 86 of the slot 78. During rotation of the input shaft 34 relative to the switch actuator member 22 from the actuated position of FIG. 4 to the overtravel or third position of FIG. 5, the pin 84 moves relative to the switch actuator member 22 along the slot 78. Thus, during rotation of the input shaft 34 from the actuated or second position of FIG. 4 to the overtravel or third position of FIG. 5, the switch actuator member 22 remains stationary and the pin 84 and shaft 34 rotate about the central axis 80 of the input shaft 34 relative to the switch actuator member.

In the illustrated embodiment of the invention, the slot 78 has been shown as being formed in the body section 56 of the switch actuator member 22. However, if desired, the slot could be formed in the input shaft 34 and a pin or other projection could be provided on the body section 56 of the switch actuator member 22 to engage the slot. It is also contemplated that other types of lost motion couplings could be provided between the switch actuator member 22 and input shaft 34 if desired.

Return Spring

The return spring 44 (FIG. 2) continuously urges the input shaft 32 toward the initial position of FIG. 3. The return spring 44 (FIG. 2) is a helical coil spring which is wrapped around the input shaft 34. The central axis of the return spring 44 is coincident with the central axis 80 of the input shaft 34.

An inner end portion 90 (FIG. 2) of the return spring 44 is fixedly connected to the input shaft 34. Thus, the inner end portion 90 of the return spring 44 has a hook-shaped configuration and is wrapped around a pin 92 which extends radially outwardly from the input shaft 34. It should be understood that the inner end portion 90 of the return spring 44 could be connected to the input shaft 34 in a different manner. For example, the inner end portion 90 of the return spring 44 could be received in a radially extending opening formed in the input shaft 34 or could be secured to the input shaft 34 by a screw or other fastener.

An opposite or outer end portion 96 of the return spring 44 is fixedly connected to the base 26. In the illustrated embodiment of the invention, the outer end portion 96 of the return spring 44 abuts the base and is held in engagement with a surface of the base by torsional forces in the spring. However, it is contemplated that the outer end portion 96 of the return spring 44 could be formed with a hook-shaped configuration and connected with a pin extending from the base or could be connected with the base 26 by a suitable fastener, such as a screw.

Counterclockwise (as viewed in FIGS. 3, 4 and 5) rotation of the input shaft 34 resiliently deflects the return spring 44 to an extent which continuously increases as the input shaft is rotated from the initial or first position of FIG. 3 to the overtravel or third position of FIG. 5. As the return spring 44 is resiliently deflected, the diameter of the coils or turns of the spring decreases slightly. In addition, as the return spring is deflected by rotation of the input shaft 34 from the initial position of FIG. 3 to the overtravel position of FIG. 5, the biasing force applied by the return spring 44 to the input shaft 34 increases. The biasing force applied by the return spring 44 to the input shaft 34 tends to rotate the input shaft in a clockwise direction from the overtravel or third position of FIG. 5 back to the initial or first position of FIG. 3.

Overtravel Spring

The overtravel spring 46 maintains the spatial relationship between the spring actuator member 22 and the input shaft 34 constant during rotation of the input shaft 34 from the initial or first position of FIG. 3 to the actuated or second position of FIG. 4. The overtravel spring 46 allows the input shaft 34 to continue to rotate, in a counterclockwise direction (as viewed in FIG. 4), from the actuated or second position to the overtravel or third position of FIG. 5. Of course, during rotation of the input shaft 34 to the overtravel or third position of FIG. 5, the spatial relationship between the input shaft and switch actuator member 22 changes as the input shaft is rotated relative to the stationary switch actuator member.

The overtravel spring 46 (FIG. 2) is a helical coil spring and is wrapped around the input shaft 34. The overtravel spring 46 is disposed on a side of the switch actuator member 22 opposite from the return spring 44. Thus, the switch actuator member 22 is disposed between the return spring 44 and overtravel spring 46. The overtravel spring 46 has a central axis which is coincident with the central axis 80 of the input shaft 34.

An inner end portion 102 (FIG. 2) of the overtravel spring 46 is fixedly connected with the switch actuator member 22. The inner end portion 102 of the overtravel spring 46 is received in a circular opening formed in the switch actuator member 22. The inner end portion 102 of the overtravel spring 46 could be connected to the switch actuator member 22 in a different manner. For example, the inner end portion 102 of the overtravel spring 46 could abut a pin projecting from the switch actuator member or be wrapped around a pin projecting from the switch actuator member.

An outer end portion 104 of the overtravel spring 46 is connected to the input shaft 34. The outer end portion 104 of the overtravel spring 44 has a hook-shaped configuration and is wrapped around a pin 106 which extends radially outwardly from the input shaft 34. Of course, the outer end portion 104 of the overtravel spring 46 could be connected with the input shaft 34 in a different manner if desired.

When the overtravel spring 46 is connected with the input shaft 34 and the switch actuator member 22, the overtravel spring is stressed somewhat. This causes the overtravel spring 46 to urge the switch actuator member 22 to rotate in a counterclockwise (as viewed in FIG. 3) direction relative to the input shaft 34. Therefore, the end surface 86 of the slot 78 is pressed against the pin 84 which extends radially outwardly from the input shaft 34.

The overtravel spring 46 provides a spring force which continuously urges the pin 84 (FIG. 3) and the end surface 86 of the slot 78 into abutting engagement during movement of the switch actuator member 22 from the initial position of FIG. 3 to the actuated position of FIG. 4. During movement of the switch actuator member 22 from the initial position of FIG. 3 to the actuated position of FIG. 4, the extent of deflection of the overtravel spring 46 remains constant. Of course, the extent of deflection of the return spring 44 increases as the switch actuator member 22 moves away from the initial position of FIG. 3 toward the actuated position of FIG. 4.

During continued counterclockwise (as viewed in FIG. 4) rotation of the input shaft 34 from the actuated position of FIG. 4 toward the overtravel position of FIG. 5, the input shaft 34 rotates relative to the stationary switch actuator member 22. This results in the overtravel spring 46 being resiliently deflected. As the overtravel spring 46 is resiliently deflected by rotation of the input shaft 34 relative to the switch actuator member 22, the coils or turns of the helical overtravel spring 46 decrease slightly in diameter.

In addition, as the input shaft 34 is rotated from the actuated position of FIG. 4 to the overtravel position of FIG. 5, the return spring 44 is resiliently deflected. This results in the input shaft 34 being urged back toward its initial spatial relationship with the switch actuator member 22 (FIG. 4) under the combined influence of the return spring 44 and the overtravel spring 46.

When the force applied to the input levers 16 and 18 by the thrust reverser door linkage (not shown) is decreased, the input shaft 34 rotates in a clockwise direction (as viewed in FIG. 5) from its maximum overtravel position back toward the actuated position of FIG. 4. As this occurs, the input shaft is rotated under the combined influence of the return spring 44 and the overtravel spring 46. When the input shaft 34 reaches the actuated position of FIG. 4, the pin 84 engages the end surface 86 of the slot 78. When the is occurs, relative rotation between the input shaft 34 and switch actuator member 22 is interrupted. The input shaft 34 and switch actuator member 22 then rotate together from the actuated position of FIG. 4 back to the initial position of FIG. 3 under the influence of only the return spring 44.

Conclusion

In view of the foregoing description, it is apparent that the switch and actuator assembly 10 constructed in accordance with the present invention, includes the improved switch actuator assembly 14. The switch actuator assembly 14 includes the switch actuator member 22 which is mounted on the rotatable input shaft 34. The return spring 44 is connected with the input shaft 34 and the base 26 of the switch actuator assembly. The overtravel spring 46 is connected with the input shaft 34 and the switch actuator member 22.

Upon rotation of the input shaft 34 from the initial position (FIG. 3) to the actuated position (FIG. 4), the switch actuator member 22 is rotated with the input shaft 34 to actuate the switch 12. The return spring 44 biases the input shaft 34 and switch actuator member 22 back toward the initial position. Continued rotation of the input shaft 34 from the actuated position rotates the input shaft relative to the switch actuator member 22. During this rotation, the pin 84 moves away from one end 86 of the 10 slot 78 in the switch actuator member 22 and the overtravel spring 46 is deflected along with the return spring 44.

When the direction of rotation of the input shaft 34 is reversed, the input shaft rotates relative to the switch actuator member 22 while the overtravel spring 46 urges the pin 84 toward the end 86 of the slot 78 in the switch actuator member. After the pin 84 engages the end 86 of the slot 78, rotation of the input shaft 34 from the actuated position results (FIG. 4) in the switch actuator member 22 and overtravel spring 44 moving with the input shaft. During continued rotation of the input shaft 34, the switch actuator member 22 and input shaft 34 are both urged back toward the initial position (FIG. 3) under the influence of the return spring 44.

Having described the invention, the following is claimed:

1. A apparatus for actuating a switch, said apparatus comprising a base, a stop surface connected with said base, an input shaft rotatably mounted on said base, a switch actuator member mounted on said input shaft, said input shaft and switch actuator member being rotatable relative to each other, an overtravel spring connected with said input shaft and switch actuator member, and a return spring connected with said input shaft and base, said input shaft, overt ravel spring, and switch actuator member being rotatable together relative to said base to move said switch actuator member from a first position to a second position to actuate the switch, said switch actuator member being spaced from said stop surface when said switch actuator member is in the first position, said switch actuator member being disposed in engagement with said stop surface when said switch actuator member is in the second position, said return spring being effective to urge said switch actuator member toward the first position when said switch actuator member is in the second position, said input shaft being rotatable relative to said base and switch actuator member to an overtravel position when said switch actuator member is in the second position to accommodate overtravel rotation of said input shaft, said overtravel spring being effective to apply force to said input shaft and switch actuator member to urge said input shaft away from the overtravel position when said input shaft is in the overtravel position.

2. An apparatus as set forth in claim 1 wherein said overtravel spring is a coil spring having a plurality of turns wrapped around said input shaft and said return spring is a coil spring having a plurality of turns wrapped around said input shaft.

3. An apparatus as set forth in claim 1 wherein said switch actuator member is rotatably mounted on said input shaft, said overtravel spring being effective to maintain said switch actuator member and input shaft in a first spatial relationship relative to each other during rotation of said input shaft to move said switch actuator member from the first position to the second position, said input shaft being rotatable to a second spatial relationship relative to said switch actuator member during rotation of said input shaft to the overtravel position against the influence of said overtravel spring.

4. An apparatus as set forth in claim 1 further including a limit surface connected with said actuator member, and a projection connected with said input shaft, said overtravel spring urging said projection into engagement with said limit surface during movement of said switch actuator member from the first position to the second position.

5. An apparatus as set forth in claim 1 wherein said switch actuator member includes surface means for defining an arcuate slot having a center of curvature on the axis of rotation of said input shaft, a projection extending from said shaft into said slot, said projection being disposed adjacent to a first end of said slot during movement of said actuator member from the first position to the second position, said projection being spaced from the first end of said slot when said input shaft is in the overtravel position.

6. An apparatus for actuating a switch, said apparatus comprising a base, a stop surface connected with said base, an input shaft rotatably mounted on said base, a switch actuator member rotatably mounted on a central portion of said input shaft, said switch actuator member including surface means for defining an arcuate slot having a center of curvature which is disposed on an axis of rotation of said input shaft and a central axis which is disposed in a plane extending perpendicular to the axis of rotation of said input shaft, pin means connected with said input shaft and extending into said slot in said switch actuator member, a helical overtravel spring wrapped around said input shaft and having a first end portion connected with said input shaft and a second end portion connected with said switch actuator member, said overtravel spring being effective to urge said pin means toward one end of said slot, and a helical return spring wrapped around said input shaft and having a first end portion connected with said input shaft and a second end portion connected with said base, said return spring being effective to urge said input shaft toward a first position relative to said base, said actuator member being disposed on said input shaft at a location between said overtravel spring and said return spring, said input shaft being rotatable relative to said base from a first position to a second position to move said switch actuator member from an initial position to an actuated position in which said switch actuator member engages said stop surface and is effective to actuate the switch, said return spring being resiliently deflected during rotation of said input shaft from the first position to the second position to provide a spring force urging said input shaft toward the first position, said overtravel spring being effective to apply a substantially constant spring force against said switch actuator member pressing said pin means against the one end of said slot during rotation of said input shaft from the first position to the second position, said input shaft being rotatable relative to said base and switch actuator member from the second position to an overtravel position while said switch actuator member remains stationary in the actuated position, said return spring being further deflected during rotation of said input shaft from the second position to the overtravel position to increase the spring force urging said input shaft toward the first position, said pin means being movable with said input shaft relative to said switch actuator member from a position in which said pin means is in engagement with the one end of said slot to a position in which said pin means is spaced from the one end of said slot during rotation of said input shaft from the second position to the overtravel position, said overtravel spring being resiliently deflected during rotation of said input shaft from the second position to the overtravel position to provide a force urging said pin means toward the one end of said slot.

7. An apparatus as set forth in claim 6 wherein the switch is offset to one side of said input shaft, said switch actuator member having a longitudinally extending arm section having a linear central axis which is disposed in a plane extending perpendicular to the axis of rotation of said input shaft.

8. An apparatus as set forth in claim 6 wherein said switch actuator member has a body section which extends around said input shaft, an outer end section, and an intermediate section disposed between said body section and said outer end section, said outer end section being engageable with the switch to actuate the switch, said intermediate section being engageable with said stop surface to limit movement of said switch actuator member, said slot being formed in said body section of said switch actuator member.

* * * * *

UNITED STATES PATENT AND TRADEMARK OFFICE

CERTIFICATE OF CORRECTION

PATENT NO. : 5,332,878

DATED : July 26, 1994

INVENTOR(S) : James A. Borst, Donald G. Williams, Mark A. Chantry and James S. Laflam

It is certified that error appears in the above-identified patent and that said Letters Patent is hereby corrected as shown below:

Column 8, line 33, change "overt ravel" to --overtravel--.

Signed and Sealed this

Fourth Day of October, 1994

*Attest:*

Bruce Lehman

BRUCE LEHMAN

*Attesting Officer*

*Commissioner of Patents and Trademarks*